US011056754B2

(12) United States Patent
Mai et al.

(10) Patent No.: US 11,056,754 B2
(45) Date of Patent: Jul. 6, 2021

(54) FILTER ANTENNA DEVICE

(71) Applicant: AAC Technologies Pte. Ltd., Singapore (SG)

(72) Inventors: Jianchun Mai, Shenzhen (CN); Zhimin Zhu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 16 days.

(21) Appl. No.: 16/706,787

(22) Filed: Dec. 8, 2019

(65) Prior Publication Data

US 2020/0212531 A1 Jul. 2, 2020

(30) Foreign Application Priority Data

Dec. 31, 2018 (CN) ..... 201811650594.5

(51) Int. Cl.
*H01P 1/203* (2006.01)
*H01Q 1/38* (2006.01)
*H01Q 1/50* (2006.01)

(52) U.S. Cl.
CPC ..... *H01P 1/20318* (2013.01); *H01Q 1/38* (2013.01); *H01Q 1/50* (2013.01)

(58) Field of Classification Search
CPC ..... H01P 1/20318; H01P 1/2088; H01Q 1/38; H01Q 1/50; H01Q 9/045
See application file for complete search history.

(56) References Cited

U.S. PATENT DOCUMENTS 8,130,063 B2 * 3/2012 Chen ..... H01P 1/2088 333/208
8,860,532 B2 * 10/2014 Gong ..... H01P 3/121 333/202
2016/0028162 A1 * 1/2016 Ou ..... H01Q 1/2283 343/905
2020/0211987 A1 * 7/2020 Kitt ..... H01L 23/49833

FOREIGN PATENT DOCUMENTS

CN 104659479 A1 5/2015
CN 109921177 A1 6/2019

OTHER PUBLICATIONS

D. Chaturvedi, A. Kumar and S. Raghavan, "An Integrated SIW Cavity-Backed Slot Antenna-Triplexer," in IEEE Antennas and Wireless Propagation Letters, vol. 17, No. 8, pp. 1557-1560, Aug. 2018, doi: 10.1109/LAWP.2018.2855051.*

(Continued)

*Primary Examiner* — Seung H Lee
(74) *Attorney, Agent, or Firm* — W&G Law Group LLP

(57) ABSTRACT

A filter antenna device is provided, which including a SIW filter structure, a SIW radiation structure cascaded with the SIW filter structure, a feeding port and a first coplanar waveguide that are provided on a side of the first resonant cavity facing away from the back cavity, a second coplanar waveguide provided on a side of the second resonant cavity close to the back cavity, a transmission wire provided in the back cavity and connected to one end of the second coplanar waveguide, and a probe connecting the transmission wire with the metal patch. The SIW filter structure includes a first resonant cavity and a second resonant cavity that are stacked from top to bottom and communicate with each other.

9 Claims, 6 Drawing Sheets

(56) References Cited

OTHER PUBLICATIONS

Dinghong Jia et. al; Multilayer Substrate Integrated Waveguide(SIW) Filters With Higher-Order Mode Suppression; IEEE Microwave and Wireless Components Letters, vol. 26, Issue 9, Sep. 24, 2016.
PCT search report dated Feb. 6, 2020 by SIPO in related PCT Patent Application No. PCT/CN2019/113376 (4 Pages).
1st Office Action dated Mar. 20, 2020 by SIPO in related Chinese Patent Application No. 201811650594.5 (12 Pages).

* cited by examiner

FILTER ANTENNA DEVICE

TECHNICAL FIELD

The present invention relates to the field of microwave communication, and in particular, to a filter antenna device applied in the field of communication electronic products.

BACKGROUND

With the rapid development of wireless communication systems, functions of wireless communication terminals are powerful, while sizes are getting smaller and smaller. Thus, designs with a multifunctional component such as a balun filter, a power-diving filter, a filter antenna, etc. are gradually becoming an inevitable trend. Integrating the antenna and filter can effectively reduce system losses, increase a system efficiency, and reduce a system size.

However, the filter antenna in the related art does not have a structure that resists out-of-band spurious signals, so that out-of-band spurious signals cannot be well suppressed, and it is easy to be interfered by surface waves, which reduces the working efficiency of the filter antenna.

Therefore, it is necessary to provide a new filter antenna device to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
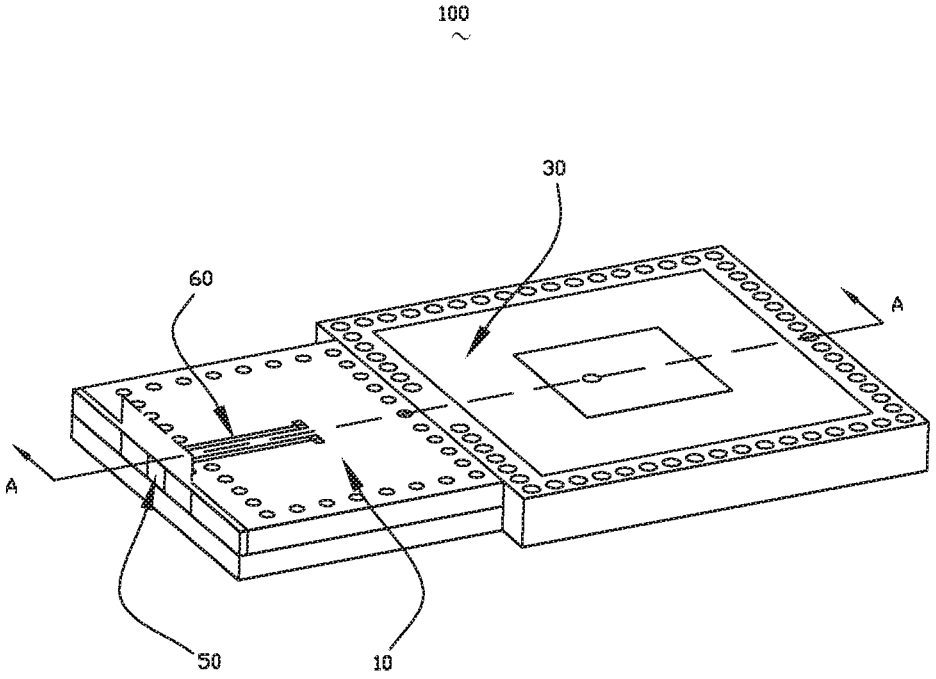
FIG. 1 is a perspective view of an overall structure of a filter antenna device.
Figure 2:
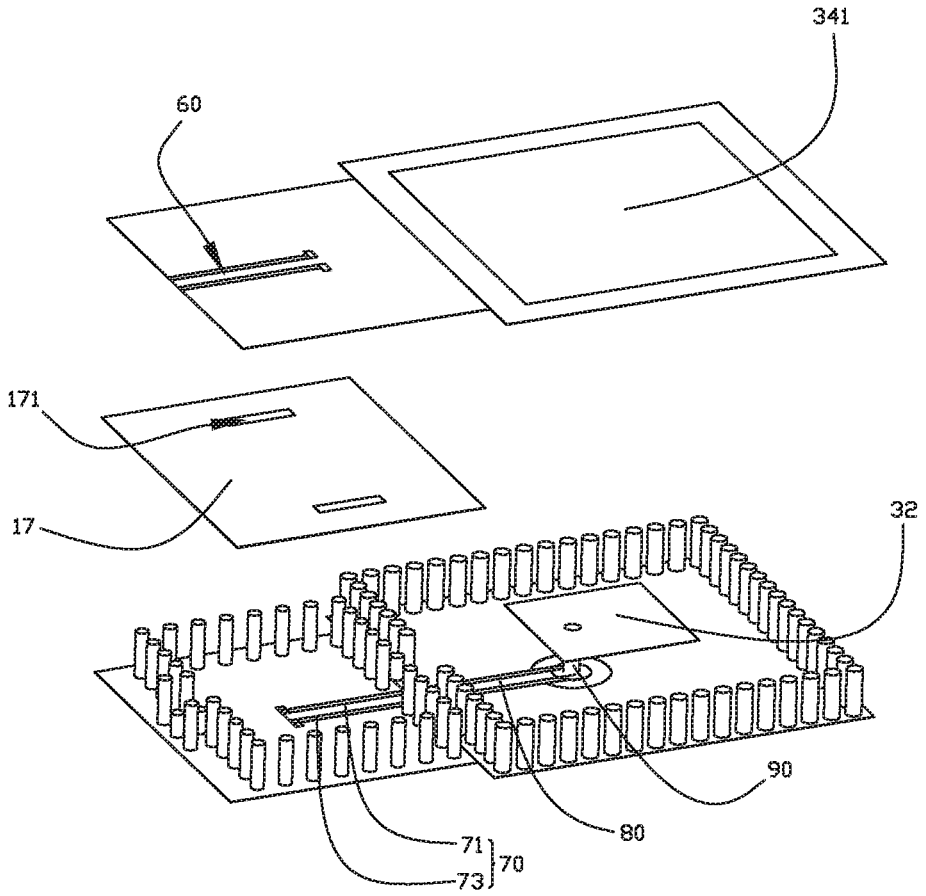
FIG. 2 is an exploded view of a part of a structure of a filter antenna device.
Figure 3:
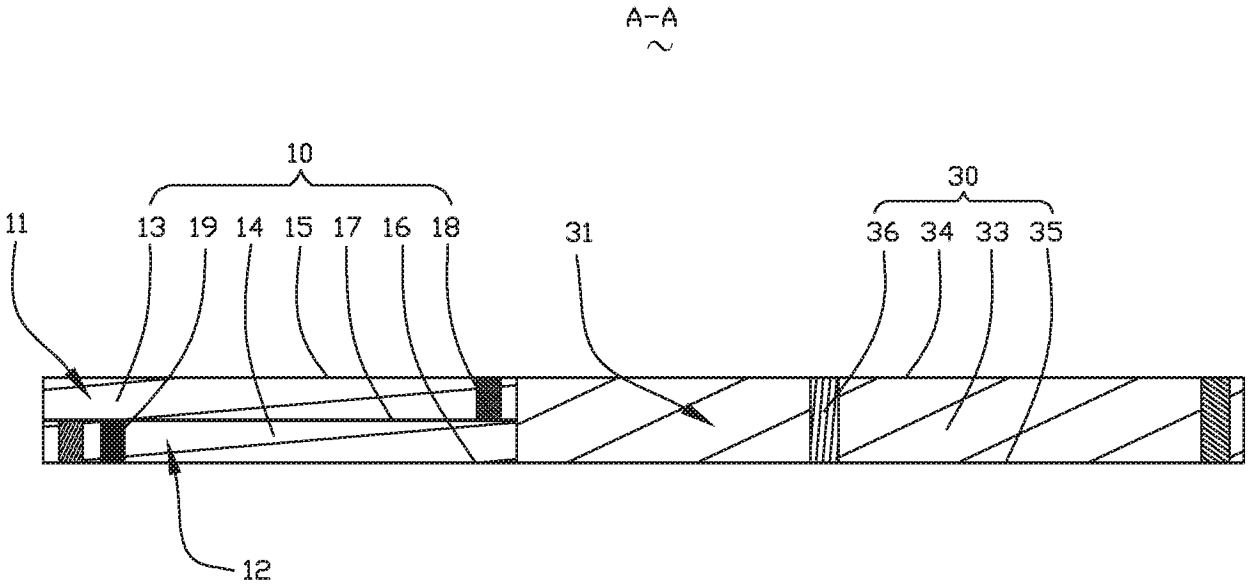
FIG. 3 is a cross-sectional view of the filter antenna device shown in FIG. 1 taken along line A-A.

Referring to FIG. 1 to FIG. 3, the present invention provides a filter antenna device 100, and it includes a SIW filter structure 10 and a SIW radiation structure 30 cascaded with the SIW filter structure 10. The SIW filter structure 10 includes a first resonant cavity 11 and a second resonant cavity 12 that are stacked from top to bottom and communicate with each other. The SIW radiation structure 30 includes a back cavity 31 provided alongside and communicating with both the first resonant cavity 11 and the second resonant cavity 12, and a metal patch 32 received in the back cavity 31.

It should be noted that the "stacking from top to bottom" in the text refers to a positional relationship in FIG. 3 of the present invention. If a placement state of the filter antenna device 100 is changed, the positional relationship between the first resonant cavity 11 and the second resonant cavity 12 is no longer stacking from top to bottom. The filter antenna device 100 further includes a feeding port 50 and a first coplanar waveguide 60 that are provided on a side of the first resonant cavity 11 facing away from the back cavity 31, a second coplanar waveguide 70 provided on a side of the second resonant cavity 12 close to the back cavity 31, a transmission wire 80 provided in the back cavity 31 and connected to one end of the second coplanar waveguide 70, and a probe 90 connecting the transmission wire 80 with the metal patch 32. The first coplanar waveguide 60 has one end connected to the feeding port 50 and another end arranged opposite to an end of the second coplanar waveguide 70 facing away from the transmission wire 80.

With such design, the back cavity 31 can effectively suppress surface waves, thereby effectively reducing the surface wave loss of the metal patch 32. Interference of out-of-band spurious signals can be effectively suppressed by providing the SIW filter structure 10 cascaded with the SIW radiation structure 30.

Optionally, the SIW filter structure 10 includes a first dielectric substrate 13 and a second dielectric substrate 14 that are stacked from top to bottom, a first metal layer 15 covering a surface of the first dielectric substrate 13 facing away from the second dielectric substrate 14, a second metal layer 16 covering a surface of the second dielectric substrate 14 facing away from the first dielectric substrate 13, a third metal layer 17 interposed between the first dielectric substrate 13 and the second dielectric substrate 14, multiple first metallized through holes 18 spaced apart from each other and penetrating the first dielectric substrate 13, and multiple second metallized through holes 19 spaced apart from each other and penetrating the second dielectric substrate 14.

Optionally, in an embodiment, both the first dielectric substrate 13 and the second dielectric substrate 14 are rectangular, and a main body of the first dielectric substrate 13 and a main body of the second dielectric substrate 14 each are made of LTCC (Low Temperature Co-fired Ceramic)

Multiple first metallized through holes 18 are arranged along a periphery of the first dielectric substrate 13 and electrically connect the first metal layer 15 with the third metal layer 17. Multiple second metallized through holes 19 are arranged along a periphery of the second dielectric substrate 14 and electrically connect the second metal layer 16 with the third metal layer 17. The first metal layer 15, the third metal layer 17 and the first metallized through holes 18 define the first resonant cavity 11. The second metal layer 16, the third metal layer 17, and the second metallized through holes 19 define the second resonant cavity 12.

Optionally, the third metal layer 17 is provided with two coupling gaps 171 spaced apart from each other, and the first resonant cavity 11 and the second resonant cavity 12 communicate with each other through the coupling gap 171.

Optionally, a shape of the coupling gap 171 is not limited in the present invention, and the coupling gap 171 can be rectangular, square, circular, or the like. In an embodiment, the coupling gap 171 is rectangular and respectively provided on two sides of the first coplanar waveguide 60.

Optionally, the first coplanar waveguide 60 is provided in the first metal layer 15 and extends from the feeding port 50 towards the back cavity 31, and the second coplanar waveguide 70 is provided in the second metal layer 16 and extends in a same direction as the first coplanar waveguide 60.

Optionally, the second coplanar waveguide 70 includes a center conductor strip 71, and planar surfaces 73 respectively located on two sides of the center conductor strip 71, and the transmission wire 80 is connected to the center conductor strip 71.

Optionally, the first metallized through hole 18 and the second metallized through hole 19 that communicate with each other are formed into one piece.

The SIW radiation structure 30 includes a third dielectric substrate 33 provided alongside the first dielectric substrate 13 and the second dielectric substrate 14, a fourth metal layer 34 and a fifth metal layer 35 that respectively cover two opposite surfaces of the third dielectric substrate 33, and multiple third metallized through holes 36 spaced apart from each other and penetrating the third dielectric substrate 33.

The multiple third metallized through holes 36 are arranged along a periphery of the third dielectric substrate 33 and electrically connect the fourth metal layer 34 with the fifth metal layer 35. The fourth metal layer 34, the fifth metal layer 35 and the multiple third metallized through holes 36 define the back cavity 31.

Optionally, the fourth metal layer 34 and the first metal layer 15 are in a same plane, and the fifth metal layer 35 and the second metal layer 16 are in a same plane.

A radiation window 341 is provided in a center of the fourth metal layer 34, and the metal patch 32 is provided in the radiation window 341. The transmission wire 80 is provided in the fifth metal layer 35. The probe 90 penetrates the third dielectric substrate 33 and electrically connects the metal patch 32 with the transmission wire 80.

Figure 4:
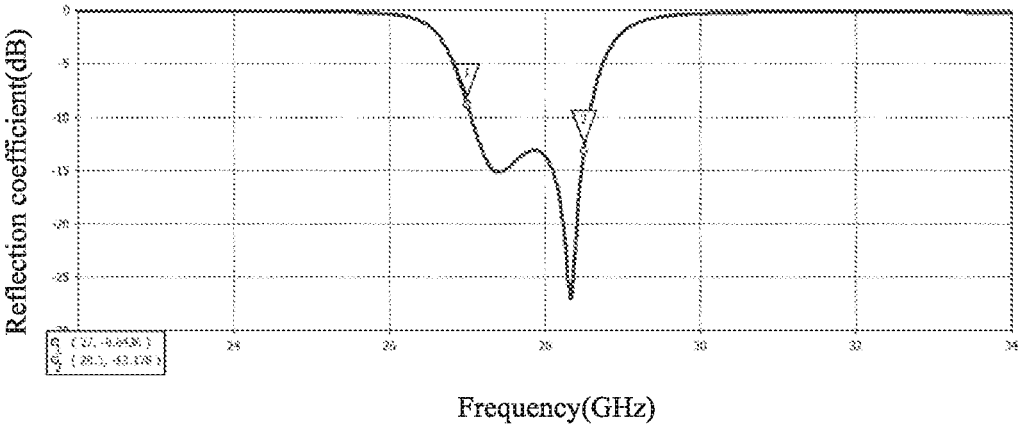
FIG. 4 illustrates a reflection coefficient of a filter antenna device.
Figure 5:
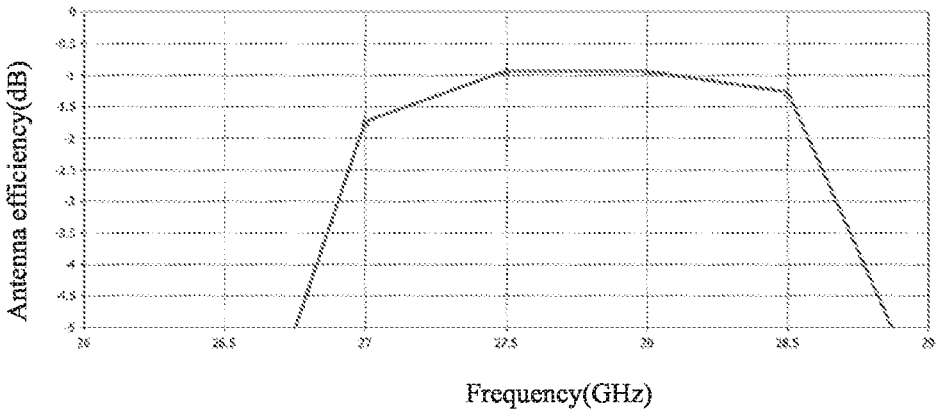
FIG. 5 illustrates an overall efficiency of a filter antenna.
Figure 6:
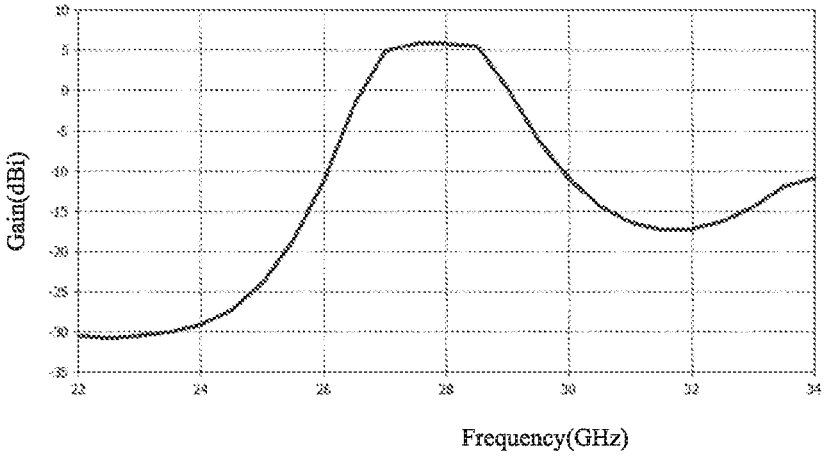
FIG. 6 illustrates a gain of a filter antenna device.

The performance of the filter antenna device 100 provided by the present invention is shown in FIGS. 4-6. Referring to FIGS. 4-6, it can be seen from the drawing that the filter antenna device 100 provided by the present invention optimizes a filter antenna scheme in a compact environment, and effectively reduces the surface wave loss by suppressing interferences of the out-of-band spurious signals.

Compared with the related art, the filter antenna device 100 of the present invention is provided with the back cavity 31 in the SIW filter structure 10 and provided the metal patch 31 in the back cavity, and because the back cavity 31 can effectively suppress surface waves, the surface wave loss of the metal patch 31 is effectively reduced, and interference of out-of-band spurious signals can be suppressed by providing the SIW filter structure 10 cascaded with the SIW radiation structure 30.

What has been described above are only some embodiments of the present invention, and it should be noted herein that one ordinary person skilled in the art can make improvements without departing from the inventive concept of the present invention, but these improvements are all within the scope of the present invention.

What is claimed is:

1. A filter antenna device, comprising:

an Substrate Integrated Waveguide (SIW) filter structure;

an SIW radiation structure cascaded with the SIW filter structure, wherein the SIW filter structure comprises a first resonant cavity and a second resonant cavity that are stacked from top to bottom and communicate with each other, the SIW radiation structure comprises a back cavity arranged alongside and communicating with both the first resonant cavity and the second resonant cavity, and a metal patch received in the back cavity;

a feeding port and a first coplanar waveguide that are provided on a side of the first resonant cavity facing away from the back cavity;

a second coplanar waveguide provided on a side of the second resonant cavity close to the back cavity;

a transmission wire provided in the back cavity and connected to one end of the second coplanar waveguide; and a probe connecting the transmission wire with the metal patch, wherein the first coplanar waveguide has one end connected to the feeding port and another end opposite to an end of the second coplanar waveguide facing away from the transmission wire.

2. The filter antenna device as described in claim 1, wherein the SIW filter structure comprises a first dielectric substrate and a second dielectric substrate that are stacked from top to bottom, a first metal layer covering a surface of the first dielectric substrate facing away from the second dielectric substrate, a second metal layer covering a surface of the second dielectric substrate facing away from the first dielectric substrate, a third metal layer interposed between the first dielectric substrate and the second dielectric substrate, a plurality of first metallized through holes spaced apart from each other and penetrating the first dielectric substrate, and a plurality of second metallized through holes spaced apart from each other and penetrating the second dielectric substrate; wherein the plurality of first metallized through holes is arranged along a periphery of the first dielectric substrate and electrically connects the first metal layer with the third metal layer; the plurality of second metallized through holes is arranged along a periphery of the second dielectric substrate and electrically connects the second metal layer with the third metal layer; the first metal layer, the third metal layer and the plurality of first metallized through holes define the first resonant cavity, and the second metal layer, the third metal layer and the plurality of second metallized through holes define the second resonant cavity;

wherein the SIW radiation structure comprises a third dielectric substrate provided alongside the first dielectric substrate and the second dielectric substrate, a fourth metal layer and a fifth metal layer respectively covering two opposite surfaces of the third dielectric substrate, and a plurality of third metallized through holes spaced apart from each other and penetrating the third dielectric substrate; wherein the plurality of third metallized through holes is arranged along a periphery of the third dielectric substrate and electrically connects the fourth metal layer with the fifth metal layer, and the fourth metal layer, the fifth metal layer and the plurality of third metallized through holes define the back cavity.

3. The filter antenna device as described in claim 2, wherein the fourth metal layer and the first metal layer are disposed in a same plane, and the fifth metal layer and the second metal layer are disposed in a same plane.

4. The filter antenna device as described in claim 2, wherein the first coplanar waveguide is provided in the first metal layer and extends from the feeding port towards the back cavity, and the second coplanar waveguide is provided in the second metal layer and extends in a same direction as the first coplanar waveguide.

5. The filter antenna device as described in claim 4, wherein a radiation window is provided in a center of the fourth metal layer, the metal patch is provided in the radiation window, the transmission wire is provided in the fifth metal layer, and the probe penetrates the third dielectric substrate and electrically connects the metal patch with the transmission wire.

6. The filter antenna device as described in claim 5, wherein the second coplanar waveguide comprises a center conductor strip and planar surfaces on two sides of the center conductor strip, and the transmission wire is connected to the center conductor strip.

7. The filter antenna device as described in claim 6, wherein the two coupling gaps are rectangular and are respectively provided on two sides of the first coplanar waveguide.

8. The filter antenna device as described in claim 5, wherein the third metal layer is provided with two coupling gaps spaced apart from each other, and the first resonant cavity and the second resonant cavity communicate with each other through the two coupling gaps.

9. The filter antenna device as described in claim 2, wherein one of the plurality of first metallized through holes and one of the plurality of second metallized through holes that communicate with each other are formed into one piece.

* * * * *